US005651594A

United States Patent [19]

Lechman

[11] Patent Number: 5,651,594

[45] Date of Patent: Jul. 29, 1997

[54] WORK STATION FOR USE WITH FLAT MONITORS

[75] Inventor: John N. Lechman, Effingham, Ill.

[73] Assignee: Nova Solutions, Inc., Effingham, Ill.

[21] Appl. No.: 451,027

[22] Filed: May 31, 1995

[51] Int. Cl.[6] ..... A47B 81/06

[52] U.S. Cl. ..... 312/194; 312/223.3; 312/223.2

[58] Field of Search ..... 248/919, 923, 248/917, 286.1; 312/223.3, 223.2, 194

[56] References Cited

U.S. PATENT DOCUMENTS

| | | | |
|---|---|---|---|
| Re. 34,266 | 6/1993 | Schairbaum . | |
| 1,842,991 | 1/1932 | MacIntosh | 248/286.1 |
| 2,464,856 | 3/1949 | Finley | 248/286.1 X |
| 4,590,866 | 5/1986 | Schairbaum . | |
| 4,755,009 | 7/1988 | Price et al. | 312/194 |
| 4,934,643 | 6/1990 | Militano, Jr. | 248/286.1 X |
| 5,071,204 | 12/1991 | Price et al. . | |
| 5,087,010 | 2/1992 | Walters . | |
| 5,125,727 | 6/1992 | Lechman et al. | 312/194 |
| 5,199,773 | 4/1993 | Price, Jr. et al. | 312/194 X |
| 5,205,631 | 4/1993 | Wegman et al. | 312/348.3 |
| 5,290,099 | 3/1994 | Lechman . | |
| 5,294,193 | 3/1994 | Wegman et al. | 312/223.3 |
| 5,364,177 | 11/1994 | Ugalde | 312/194 |
| 5,408,939 | 4/1995 | Lechman | 312/223.3 X |
| 5,410,972 | 5/1995 | Schairbaum | 248/923 X |

FOREIGN PATENT DOCUMENTS

| | | |
|---|---|---|
| 1106895 | 8/1981 | Canada . |

*Primary Examiner*—Peter M. Cuomo
*Assistant Examiner*—Stephen Vu
*Attorney, Agent, or Firm*—Olson & Hierl, Ltd.

[57] ABSTRACT

A flat monitor is associated with a work station in inset relationship to the top surface of the station's work platform so as to be non-interfering with this top surface usage. The flat monitor is either supported below an inset transparent window in the work platform or supported in a bore defined in the work platform, with the flat monitor preferably provided with a protective transparent film or sheet.

3 Claims, 4 Drawing Sheets

WORK STATION FOR USE WITH FLAT MONITORS

FIELD OF THE INVENTION

The present invention relates to work stations for use with computer monitors.

BACKGROUND

It is heretofore known to provide a transparent surface portion on the top of a desk or other work station for use with a cathode ray tube or monitor. The cathode ray tube is positioned under the desk top for viewability through the transparent surface so that the top of the work station is not obstructed by the cathode ray tube. Such devices also may include adjustable assemblies for supporting the monitor underneath the desk to enable the user to tilt and raise or lower the monitor to enhance the user's comfort. Examples of prior art work stations and work station assemblies are disclosed in U.S. Pat. Nos. RE 34,266 to Schairbaum, 4,755,009 to Price et al., 5,125,727 to Lechman et al., 5,290,099 to Lechman, and 5,205,631 to Wegman et al.

A shortcoming of the prior art devices is that virtually all of the devices are designed for use with computers that utilize cathode ray tube monitors. In light of the increasing popularity of flat computer monitors, however, what is needed is a work station that is designed especially for use with flat computer monitors. Desirably, such a work station will be designed to accommodate differing desired or needed spatial dimensions and orientations of the flat monitor supported by the work station.

Accordingly, it is an object of this invention to provide a work station for use with flat computer monitors.

It is a further object of this invention to provide such a work station that provides means for supporting the flat monitor beneath the top surface of the work station so that the monitor can be viewed through an open or a transparent portion of the top surface.

It is a further object of this invention to provide such a work station where the means for supporting the flat monitor is adjustable to accommodate differing orientations of the flat monitor.

SUMMARY

In accordance with these and other objects, the present invention provides a work station or desk adapted to be used with a computer system having a flat monitor. The work station generally comprises a work table or platform, a keyboard tray slidingly engaged with the work station, and, if desired, a drawer for housing the central processing unit (CPU). The work table is supported by a plurality of walls or support members that define a knee-hole region and a drawer region.

In accordance with one embodiment of the invention, a bore having a bottom surface is formed in the top surface of the work table for receiving and supporting the flat monitor. If desired, a sheet of glass or other transparent material may be hingedly connected to the top surface of the work table adjacent the bore for encasing the flat monitor when it is positioned within the bore.

In accordance with further embodiments of the invention, a through opening is formed in the work table, and an adjustable monitor support assembly is provided to support a flat monitor beneath the work table for viewability through the opening. The support assembly comprises generally a flat support member hingedly connected to the bottom of the work platform adjacent the opening. A lip extends upward from the support member at an angle of approximately 90 degrees to further support the monitor. Means are also provided for pivoting the support member in the form of a pair of arms that adjustably connect the support to the walls of the work station. If desired, the pivoting means may be responsive to the inward and outward sliding of the keyboard supporting tray.

The monitor support assembly may be formed of interwelded heavy wire components to make the assembly light in total weight and also provide excellent capacity for air circulation for monitor cooling purposes.

The work station in accordance with a further embodiment of the invention includes an opening formed in the work table, and a monitor support member that extends from the proximal end of the keyboard tray at an upward angle. By sliding the keyboard tray outward, the monitor support member can be positioned so that the flat monitor can be viewed through the opening. This embodiment is intended for use with one-piece commercial flat monitor computers.

The work station in accordance with the present invention offers a substantial advance in the art because it is designed for use with a flat monitor. Since the flat monitor can be positioned below or flush with the top surface of the work station, the surface is not obstructed by the monitor. Moreover, the adjustable supporting means, if included, accommodates differing spatial positions and orientations of the flat monitor for enhancing viewing comfort.

BRIEF DESCRIPTION OF THE DRAWINGS

The present invention and the advantages thereof will become more apparent upon consideration of the following detailed drawings when taken in conjunction with the accompanying drawings, in which.

DETAILED DESCRIPTION OF THE PREFERRED EMBODIMENTS

Figure 1:
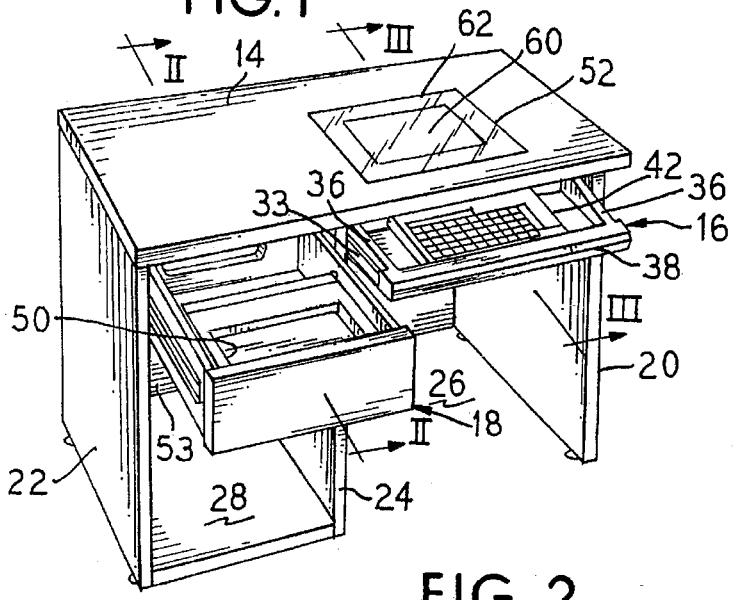
FIG. 1 is a perspective of a work station in accordance with one embodiment of the invention.

The work station in accordance with the preferred embodiments of the invention is in the form of a desk 10 that comprises a work table or platform 12 having top and bottom surfaces 14, 15, a keyboard tray 16, and, if desired, a drawer 18 for housing the central processing unit (CPU). The work table is supported by a pair of side walls 20, 22 and a central wall 24, which define a knee-hole region 26 and a drawer region 28.

Preferably, the keyboard tray 16 comprises two opposed lateral sides 36 and proximal and distal sides 34, 38. The keyboard tray may be slidingly engaged with the desk in any suitable manner so that it slides from a first position in which it is disposed substantially within the knee-hole region 26 to a second position that extends outward from the knee-hole region. In the illustrated embodiments, for example, the keyboard tray 16 is connected to side wall 20 and central wall 24 by a pair of horizontally-extending slide members 30 secured to walls 20 and 24 which slidingly engage a pair of horizontally-extending rails 32 secured to the opposed sides of the keyboard tray 16. A plurality of rollers (not shown) may be rotatably secured to the rails and received by the slide members in accordance with conventional drawer assemblies.

Preferably, a portion of each of the rails 32 extends from the proximal side 34 of the keyboard tray 16 to increase the outward extension of the tray relative to the knee-hole region 26. The opposed sides 36 of the keyboard tray may be sloped upward from the distal side 38 to the proximal side 34 of the tray to compliment a similarly-sloping keyboard 42 (see FIG. 3).

The drawer 18 may be slidingly engaged to the desk 10 in any suitable manner so that it slides from a first position in which it is substantially disposed within the drawer region 28 to a second position that extends outward from the drawer region. In the illustrated embodiments, for example, the desk is slidingly connected to side wall 22 and central wall 24 in substantially the same manner as the keyboard tray 16 is secured to side wall 20 and the central wall, with horizontally-extending slide members 30' slidingly engaging the horizontally-extending rails 32'. The rails 32' do not extend from the proximal side 34' of the drawer, however, because it is not desirable for the drawer 18 to extend completely outside the drawer region. If desired, the drawer may include a generally rectangular cavity 50 formed in the bottom surface of the drawer for securably receiving the CPU. One or more apertures 51 may be formed in the proximal side 34' of the drawer, central wall 24, and a back wall 53 of the desk 10 to receive necessary electric cables 55.

Figure 2:
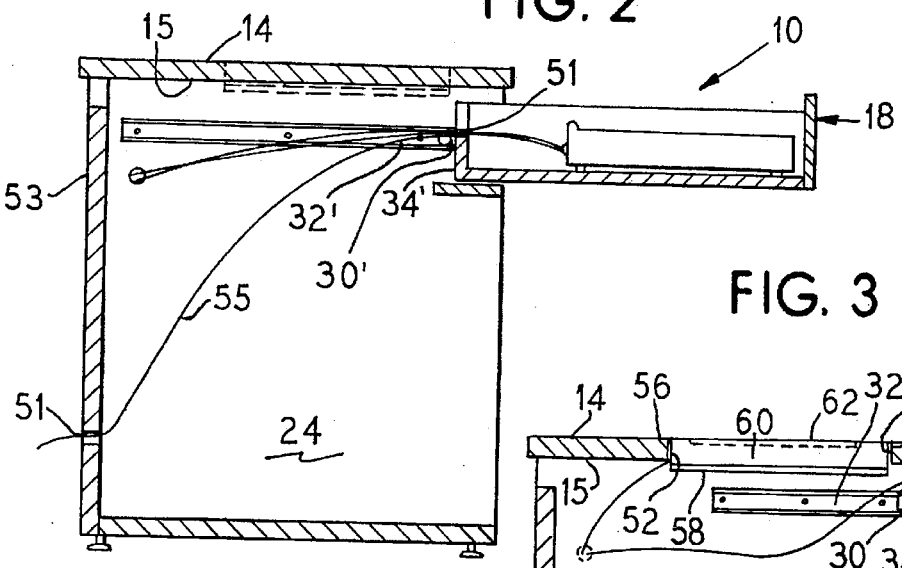
FIG. 2 is a vertical transverse sectional view taken along the line II—II of FIG. 1.
Figure 3:
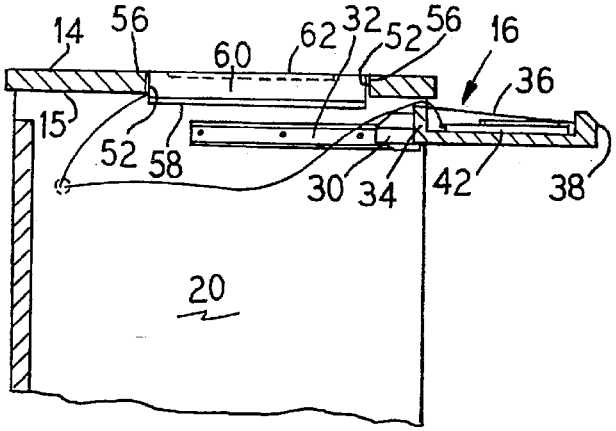
FIG. 3 is a fragmentary vertical transverse sectional view taken along the line III—III of FIG. 1.

In accordance with the first embodiment of the invention which is shown in FIGS. 1–3, a compartment or bore 52 for receiving and supporting a flat monitor 60 is formed in the top surface 14 of the work table 12. Preferably, the bore is generally rectangular, and is defined by four side walls 56 and a bottom surface 58 disposed slightly below the work table 12. The depth of the bore desirably exceeds or is substantially the same as the conventional height of the flat monitor 60. One or more apertures (not shown) can be formed in the bore to receive electric cables for supplying power to the monitor 60.

A sheet of glass 62 or other transparent surface may be included to encase the monitor 60 when it is disposed in the bore 52, with the top surface of the sheet being substantially flush with the top surface 14 of the work table 12. Preferably, the sheet 62 is hingedly connected to the top surface 14 adjacent one side of the bore 52 so that the sheet can pivot from an open to a closed position for placement and removal of the monitor.

Figure 4:
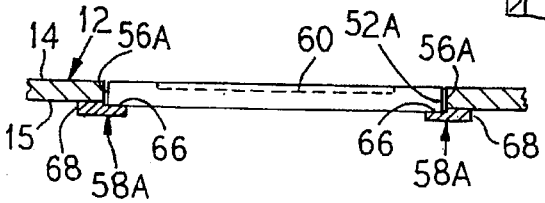
FIG. 4 is a fragmentary vertical transverse view similar to FIG. 3, taken only through a portion of the work platform, illustrating a modified form of the work station embodiment shown in FIGS. 1–3.
Figure 5:
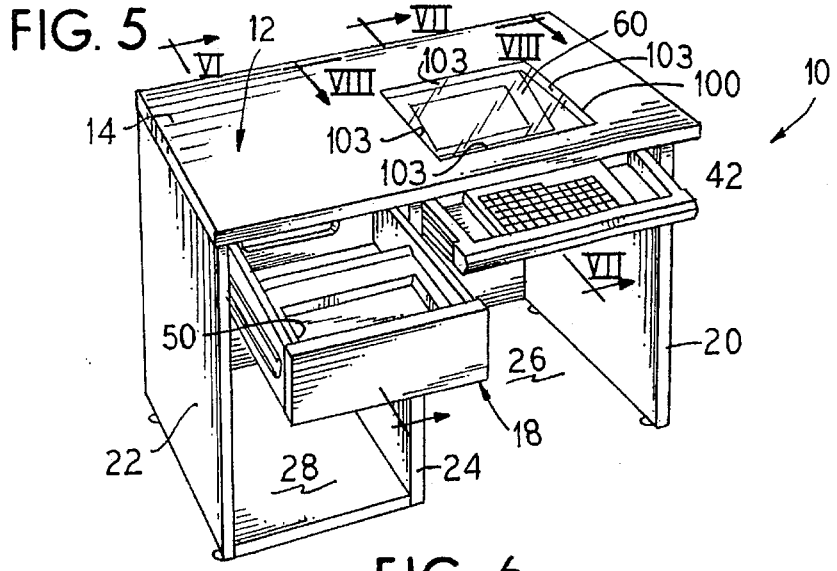
FIG. 5 is a perspective of a work station in accordance with an alternative embodiment of the invention.
Figure 6:
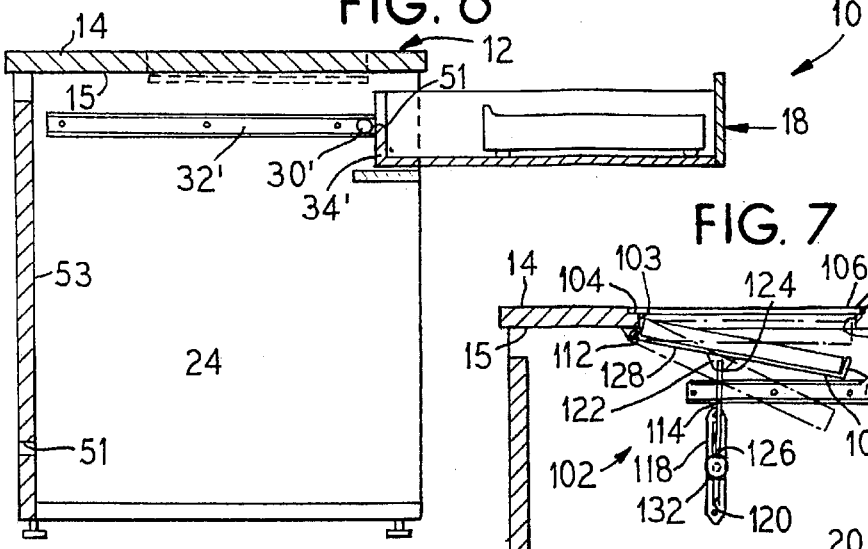
FIG. 6 is a vertical transverse sectional view taken along the line VI—VI of FIG. 5.

FIG. 4 illustrates a modification of the first embodiment of the invention wherein the bore 52A is instead defined by four walls 56A, and a ledge 58A extending around the periphery of the bore just beneath the work table 12 for supporting the monitor. The ledge is defined by a shoulder member 66 integral with a base member 68, with the base member being secured to the bottom surface 15 of the work table 12 adjacent the bore 52A so that the shoulder member extends slightly beneath the work table 12. The base member 68 may be secured to the bottom surface 15 of the work table 12 in any suitable manner, such as by the use of fasteners or an adhesive.

FIGS. 5–8 illustrate a second embodiment of the invention wherein a generally rectangular through opening 100 is formed in the work table 12, and an adjustable assembly 102 is provided for supporting the flat monitor 60. In this embodiment, the opening 100 is defined by four side walls 103. If desired, a generally rectangular recess or lip 104 may be formed in the top surface 14 of the work table 12 immediately adjacent the periphery of the opening (see FIGS. 7–8). The recess 104 is for receiving and supporting a sheet of glass 106 or other transparent material having a top surface substantially flush with the top surface of the work table 12. Preferably, the sheet 106 is hingedly connected to the top surface 14 adjacent to one side wall 103 of the opening 100 so that it can pivot from an open to a closed position covering the opening 100 for placement and removal of the monitor 60 as supported by assembly 102.

Figure 7:
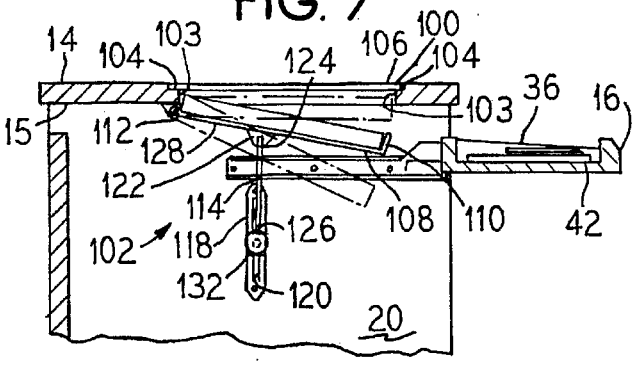
FIG. 7 is a fragmentary vertical transverse sectional view taken along the line VII—VII of FIG. 5.

The assembly 102 comprises a substantially flat support member 108 having a lip 110 extending upward from the support member 108 at an angle of approximately 90 degrees, as shown in FIG. 7. The proximal side 112 of the support member 108 is hingedly connected to the bottom surface 15 of the work table 12 adjacent the opening 100 so that the support member can pivot toward the opening. The support member 108 further comprises a pair of arms 114 which adjustably connect the opposed sides 116 of the support member 108 to a pair of brackets 118 secured respectively to each of side wall 20 24 and the central wall 20. Desirably, the brackets 118 are vertically mounted to these walls 20 and 24, bracket 118 has an elongated, vertically-oriented slot 120 formed therein (see FIG. 7).

Figure 8:
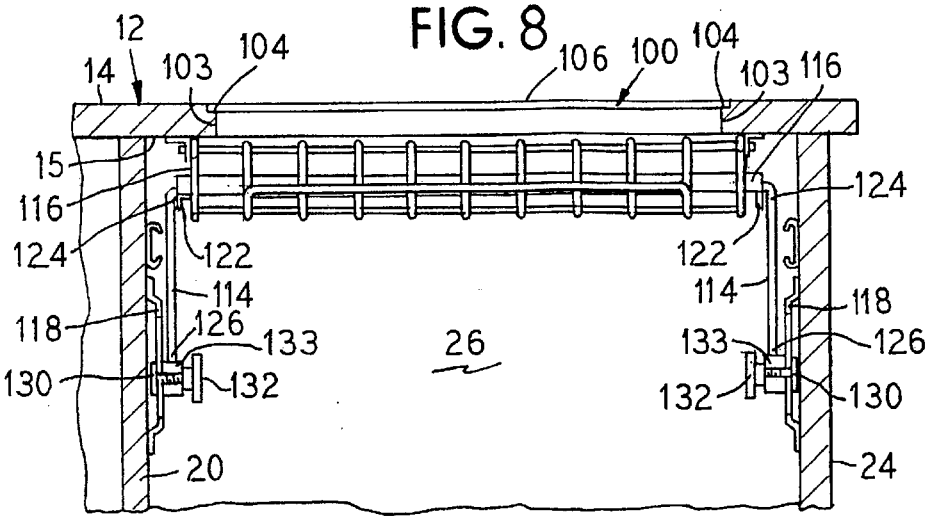
FIG. 8 is a fragmentary vertical longitudinal sectional view taken along the line VIII—VIII of FIG. 5.

One end 124 of each arm 114 is pivotally connected to a down-turned ear or boss 122 mounted to the opposed sides 116 of the bottom not shown and not needed of the support member 108 at the approximate center of the length of the support member. The other end 126 of each arm 114 is adjustably secured to one of the brackets 118 in any suitable manner, such as by a carriage bolt 130 slidingly engaged with slot 120 and a knob 132 having a projecting base, as shown in FIGS. 7 and 8. With this construction, the other end 126 of each of the arms 114 terminate in a clamp or brace 133 that also defines an internally-threaded horizontal passage for slidably engaging the base of the knob 132. An internally-threaded axial not detailed is formed in the knob, 132 and the threaded shank of the bolt 130 extends through the elongated slot 120 formed in the bracket 118 and through the passage in the brace 133 and is received within the bore of the knob 132 for screwing engagement therewith.

With this embodiment, the support member 108 is first oriented at a desired angle, causing the bolt 130 and knob 132 assembly to slide along the elongated slot 120 to the desired location. The knob 132 and bolt 130 assembly is then locked in place by rotating the knob 132, which causes the bolt 130 and knob 132 to lock together at the desired location along the slot 120. Thereafter, the knob 132 and bolt 130 assembly can be unlocked by rotating the knob 132 in the reverse direction and the support member 108 can be repositioned to a different angle.

Figure 10:
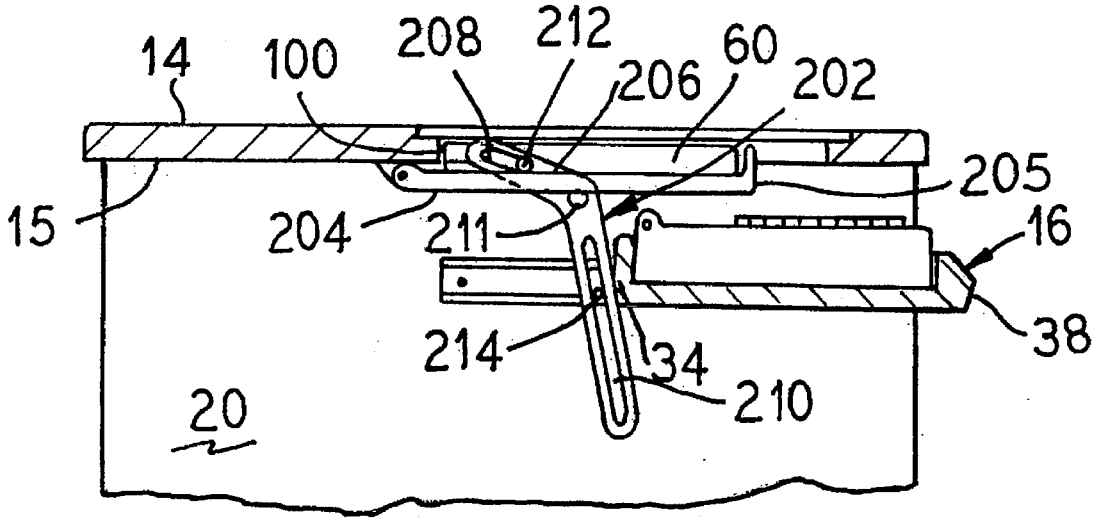
FIG. 10 is a further view of the flat monitor support of FIG. 9, illustrating the flat monitor support assembly in a storage configuration.
Figure 9:
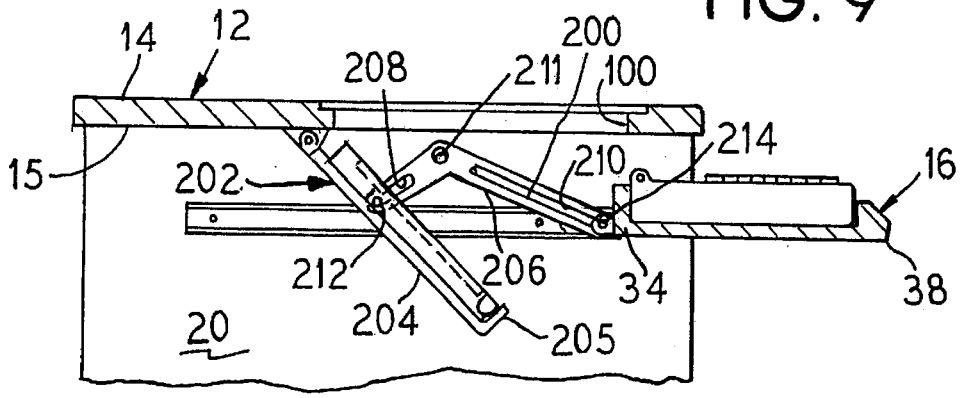
FIG. 9 is a view similar to FIG. 7 but showing an alternative embodiment of the flat monitor support assembly.

FIGS. 9 and 10 illustrate a modification of the second embodiment of the adjustable monitor support assembly generally designated here as 202. With this embodiment, a support member 204 is pivotally connected adjacent the opening 100 so that the support member can pivot towards the opening. A lip 205 extends from the unattached side of the support member at angle of approximately 90 degrees.

A pair of levers 206 adjustably secures the flat monitor 60 to the keyboard tray 16 in a manner such that the support member pivots downward in response to outward sliding of the keyboard tray, and upward in response to inward sliding of the keyboard tray. Desirably, when the keyboard tray 16 is moved to its first position, the monitor is substantially horizontal and received within the opening.

The levers 206 preferably are bent with elongated slots 208, 210 formed on each side of the bends. The levers are pivotally secured to wall at its bend by lugs 211, defining a fulcrum. A first pin 212 extends from each side of the monitor 60 and is slidingly received within one of the first elongated slots 208 of levers 206. A second pin 214 extends from the proximal side 34 of the keyboard tray 16 adjacent the opposed lateral sides 36 and is slidingly received within one of the second elongated slots 210 of the levers.

Figure 11:
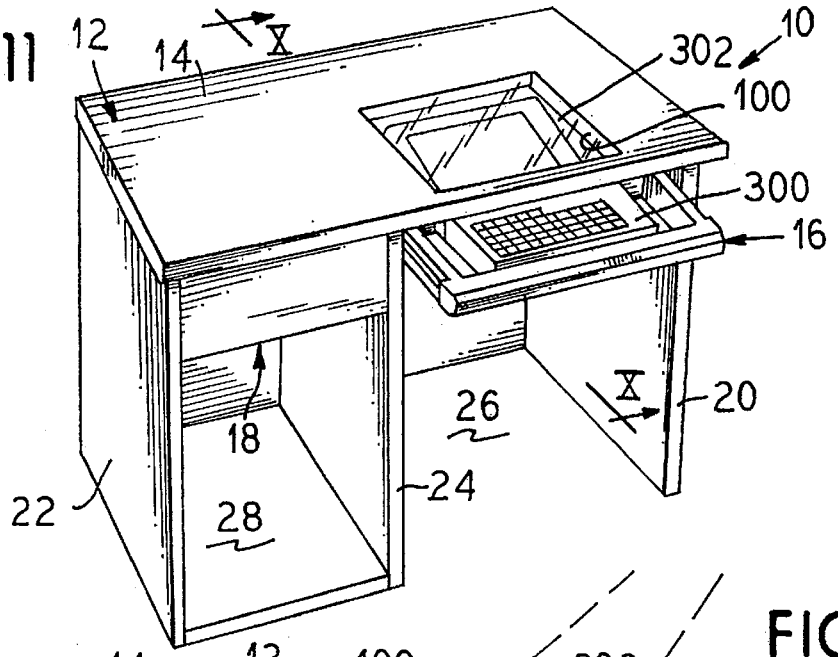
FIG. 11 is a perspective of a work station in accordance with another alternative embodiment of the invention.
Figure 12:
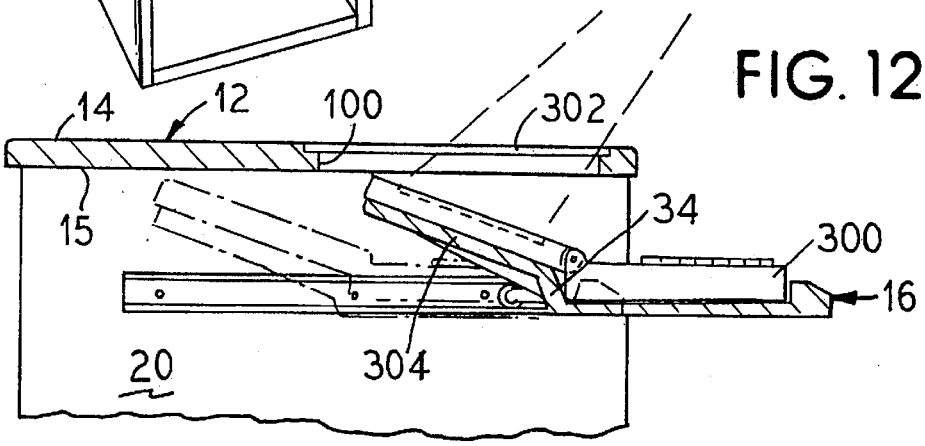
FIG. 12 is a vertical transverse sectional view taken along the line X—X of FIG. 11.

FIGS. 11 and 12 disclose a further embodiment of the invention that is especially suited for one-piece commercial flat monitor personal computers 300. In this embodiment, the opening 100 is formed in the work table 12, and a support member 304 extends from the proximal side 34 of the keyboard tray 16 for supporting the flat monitor 300. Preferably, the support member 304 is integral with the proximal wall 34 of the keyboard tray, and extends at an upward angle relative to the bottom of the keyboard tray that is in the range of 15 to 45 degrees and may be adjustable. Preferably, the proximal wall 34 extends at an angle in the range of 45 to 90 degrees relative to the bottom of the keyboard tray.

If desired, any of the components of the above described embodiments, such as the bottom surface of the bore 52 or the support assemblies 102,202 may be formed of interwelded heavy wire components to make the assembly light in total weight and also provide excellent capacity for air circulation for monitor cooling purposes (see e.g. FIG. 8).

The foregoing description is for purposes of illustration only and is not intended to limit the scope of protection accorded this invention. The scope of protection is to be measured by the following claims, which should be interpreted as broadly as the inventive contribution permits.

The claimed invention is:

1. A work station for a flat monitor comprising in combination:

a) a work station having a work platform and means for supporting said platform in spaced relationship to an underlying floor, said platform having an aperture defined therein, said platform and said means for supporting together defining a kneehole that generally extends beneath said aperture and that has a side opening in said work station for receiving the knees of a seated user at said work station; and b) a flat monitor support comprising:

(1) a generally flat support member with opposed side portions and opposed front and rear end portions and having an upturned lip along said front end portions whereby a flat monitor can rest upon said support member and said lip when said front end portions are lower than said rear end portions;

(2) hinge means pivotably connecting said rear end portions with said platform at a location thereof which is adjacent to said aperture so that said support member is downwardly pivotable into said knee hole at an inclined angle relative to said platform with said flat monitor being visible through said aperture by a seated user;

(3) arm means pivotably downwardly depending from at least one of said side portions so that said arm means can extend vertically as said support member is so pivoted;

(4) bracket means fixed to said work station generally below said aperture and including adjustable connecting means for movably and pivotably associating said bracket means with said arm means and for releasably clamping said arm means so that said inclined angle of said support member is fixable and is also adjustable by said adjustable connecting means; and (5) said bracket means comprising a pair of brackets, each said bracket being generally positioned below and in vertically spaced relationship to a respected said side portions, wherein each said bracket comprises in combination:

(a) an elongated member having a vertically oriented elongated slot defined therein and having fastening means for fastening said member to said arm means for supporting;

(b) a bolt and threaded nut means;

(c) a brace body having a channel extending therethrough and having a side positioned for receiving a lower end portion of one said arm means defined on said body perpendicularly to said channel; whereby, when said bolt is slidably extended through said slot and said channel and is engaged with said nut means, said support member is adjustably fixable at an inclined angle by said bracket means.

2. The work station of claim 1 where, in said monitor support, said arm means comprises a pair of arms, each of said arms being on a respected said opposed side portion.

3. A work station adapted for supporting a flat monitor comprising in combination:

(a) a platform having a flat monitor-receiving aperture defined therein, said aperture having front and rear edge portions and opposed side edge portions, (b) means for supporting said platform in spaced relationship to an underlying floor and defining with said platform a kneehole that extends under said aperture and has an opening located along one side of said work station for receiving the knees of a user seated at said work station, (c) adjustable support means for said flat monitor at said aperture, said means comprising in combination:

a substantially flat support member having opposed front and rear edge portions and opposed side edge portions;

an upturned lip member along said front edge portions;

hinge means pivotably connecting said back edge portions with said rear edge portions of said aperture whereby said support member is pivotable about said hinge means so as to be downwardly inclined relative to said platform;

a pair of arm member, each one being pivotably associated at an upper end portion thereof with, and downwardly dependent from, a different said side edge portion, and also pivotably associated at a lower end thereof with a different pivotable brace body, each said brace body having a channel laterally extending therethrough, a pair of brackets, each said bracket having a vertically oriented, elongated slot defined therein and each said bracket having fastening means engaged with said arm means for supporting and positioning each said bracket below a different said side edge portion;

a pair of nut and bolt means, each said nut and bolt means having said bolt thereof extended through each slot and each said channel, whereby when said bolt thereof is associated with said nut thereof, said bolt is slidably moveable in said slot but is fixed relative to said brace body so that, when said nut is tightened upon said bolt, said support member is adjustably positionable at a desired inclination angle.

* * * * *